United States Patent [19]

Brühmann et al.

[11] Patent Number: 4,735,182

[45] Date of Patent: Apr. 5, 1988

[54] CENTRIFUGAL SPEED GOVERNOR OF FUEL INJECTION PUMPS

[75] Inventors: Werner Brühmann; Ernst Ritter, both of Stuttgart, Fed. Rep. of Germany

[73] Assignee: Robert Bosch GmbH, Stuttgart, Fed. Rep. of Germany

[21] Appl. No.: 41,086

[22] PCT Filed: Aug. 14, 1986

[86] PCT No.: PCT/DE86/00332

§ 371 Date: Mar. 23, 1987

§ 102(e) Date: Mar. 23, 1987

[87] PCT Pub. No.: WO87/01162

PCT Pub. Date: Feb. 26, 1987

[30] Foreign Application Priority Data

Aug. 16, 1985 [DE] Fed. Rep. of Germany ..... 3529449
Jul. 31, 1986 [DE] Fed. Rep. of Germany ..... 3625985

[51] Int. Cl.[4] ..... F02D 31/00

[52] U.S. Cl. ..... 123/373; 123/364

[58] Field of Search ..... 123/373, 372, 374, 364

[56] References Cited

FOREIGN PATENT DOCUMENTS 2224758 12/1973 Fed. Rep. of Germany ..... 123/373
2020893 7/1970 France ..... 123/373

*Primary Examiner*—Henry Bennett
*Attorney, Agent, or Firm*—Michael J. Striker

[57] ABSTRACT

Centrifugal speed governor of fuel injection pumps for internal combustion engines comprising a centrifugal force adjuster, which actuates an articulated head with its centrifugal weights. The articulated head articulates a double-armed guide lever with brackets by means of an axle. The axle 17 is supported by means of a cross bearing in the articulated head and in a borehole has an oblong cross section which in the adjusting direction, so that the axle can execute a limited swiveling movement about the cross bearing in the borehole.

6 Claims, 3 Drawing Sheets

CENTRIFUGAL SPEED GOVERNOR OF FUEL INJECTION PUMPS

BACKGROUND OF THE INVENTION

The invention pertains to a centrifugal speed governor of fuel injection pumps. Such speed governors are commercially available as variable-speed governors or idling speed governors from the Bosch company under the designation EP/RSV and EP/RSF. In these speed governors, which are produced in large-scale production, the points of support and application, which are very accurately fixed in theory, divrege from the provided positions as a result of manufacturing defects. These deviations can either be corrected by means of subsequent, and accordingly expensive, treatment of the parts in question or they must be compensated for by means of a corresponding construction of the governor parts. Such compensation is achieved, for example, in the double-armed guide lever, with its box-type construction, in that the latter is constructed so as to be torsionally resilient. However, torsional resilience has the disadvantage that the control is accordingly inaccurate as a whole and inclines toward considerable scatter or straying and that the adjustability of the governor is accordingly made substantially more difficult.

If, in addition, the governor works with an adapting or torque control device in which a "fuel adaptation" is achieved, as in these EP/RS governors, in that the order to define an exact control curve it is necessary that dwell points be given for the adjustment, for example, during the transition to the regulation point. These disadvantages make themselves felt particularly in the idling speed governor, in which the regulation point for preventing damage to the engine, in particular, is allowed to begin only after a given speed, which is not adjustable because of the absence of a dwell point. It is only possible to fully exploit this maximum speed of the engine when the maximum rate of rotation of the engine can be very precisely controlled by means of the fuel injection pumps.

In another known centrifugal speed governor of the type mentioned in the beginning (DE-PS No. 1011223), the adjusting piece, which is constructed as an adjusting sleeve, is guided on a shaft stub of the centrifugal weight adjuster and, by means of a roller bearing in which the articulated head is inserted with a corresponding pin, acts axially on the latter. The articulated head comprises an axle stub which extends transversely relative to the adjusting direction and on which the brackets of the guide lever act via elongated holes which are open at the bottom. This construction has the disadvantage that constructional inaccuracies of the lever bearing, as well as alignment errors of the regulating movements, are either not compensated for or are compensated for by means of the torsional elasticity of the guide lever, both of which lead either to excessive friction or to the aforementioned control errors.

ing on a point of application of force exactly between the two brackets of the guide lever. The solution can preferably be applied in a governor in which, in a manner known per se, the guide lever is arranged on the pivot bearing with lateral play.

According to another advantageous construction of the invention, there is a cross pin which serves as a cross bearing and which penetrates the articulated head at least partly and is penetrated by the axle, by means of which a simpler construction for the assembly can be achieved. According to another construction of the invention, there is play between the articulated head and the brackets which makes possible an easy lateral displacement of the articulated head with respect to the guide lever and with respect to the central line of force when, for example, there is a lateral offsetting of the guide lever relative to the centrifugal weight adjuster as a result of manufacture. This displacement of the articulated head can be effected on the axle or by means of the displacement of the axle ends in the brackets of the guide lever.

According to an additional construction of the invention, the axle ends are fixedly connected with the brackets of the guide lever in order thereby to improve its rigidity. Along the same lines, there is another construction of the invention according to which there is a spacer pin between the brackets as one of the cross connections in the vicinity of the pivot bearing of the guide lever, which spacer pin is fixedly connected—for example, riveted—with the brackets on both sides.

Other advantages and advantageous constructions of the invention can be derived from the following description, drawing and claims.

DETAILED DESCRIPTION OF THE PREFERRED EMBODIMENT

Figure 1:
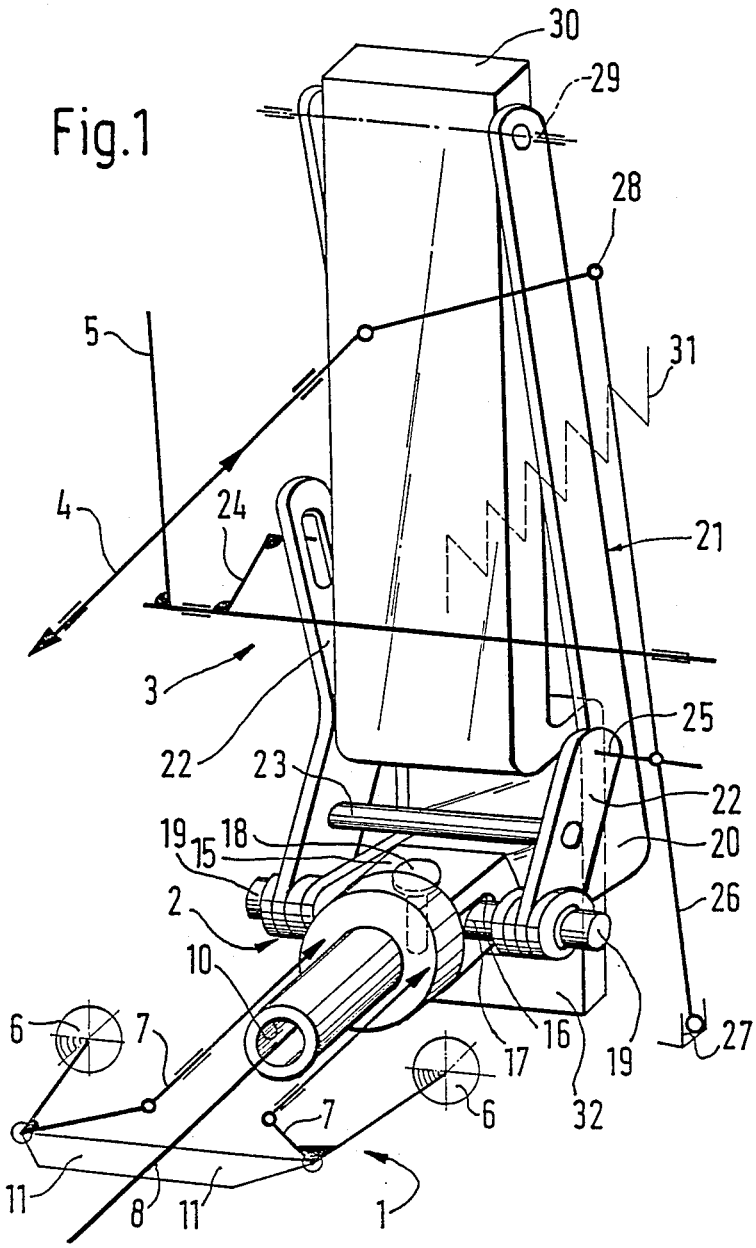
FIG. 1 shows a perspective view of the portions of the governor, which are substantial for the invention, with schematically shown additional portions of the governor.

Referring now to the drawings in detail, in FIG. 1, a centrifugal weight adjuster, designated by 1, acts on an adjusting piece, which latter acts on a quantity control member 4, only shown schematically, by means of a lever system 3. The lever system 3 can be engaged, as desired, by means of an adjusting lever 5.

Figure 2:
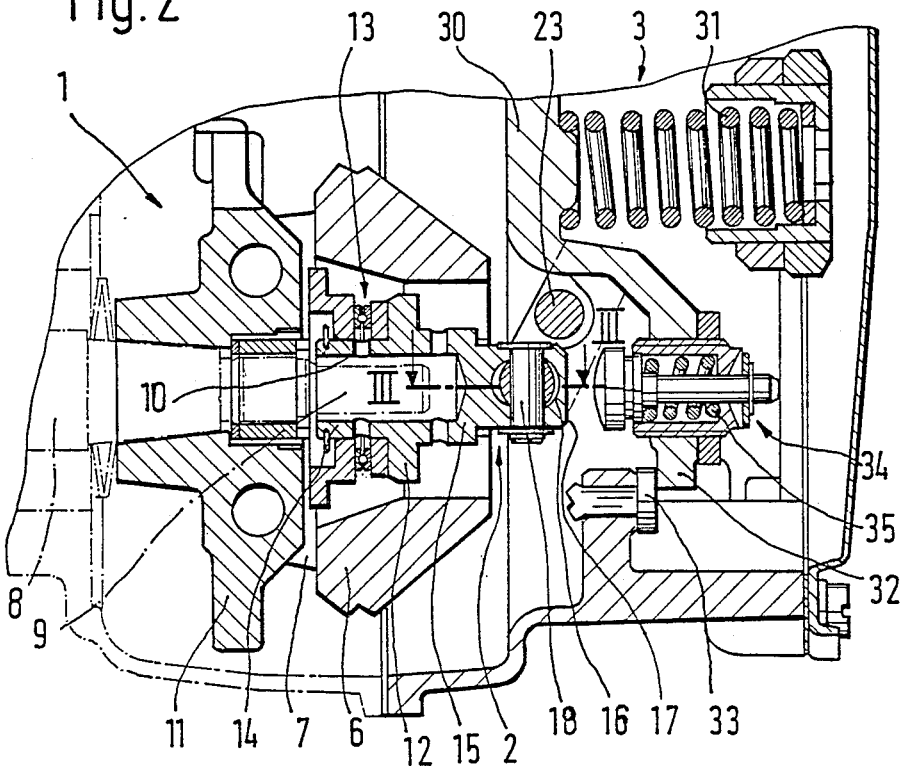
FIG. 2 shows a longitudinal section through the area of the centrifugal weight adjuster and articulated head of the first embodiment.

In the centrifugal weight adjuster 1, which is shown in a purely schematic manner in FIG. 1 and is shown in FIG. 2, the centrifugal weights 6 act on the adjusting piece 2 in section by means of the angle lever 7, wherein the adjusting forces correspond to the centrifugal forces and, accordingly, to the rate of rotation. The centrifugal weight adjuster 1 is driven by means of a shaft 8 whose end 9 is guided in an inner borehole 10 of the adjusting piece 2. The centrifugal weights 6, with levers 7, are supported at connecting bars 11 which rotate with the shaft 8.

Figure 3:
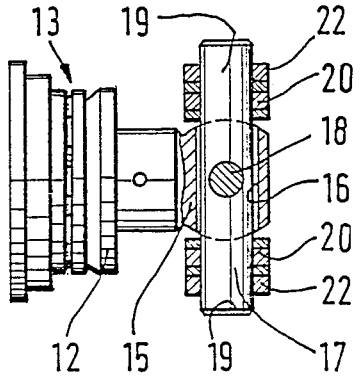
FIG. 3 shows a section through the articulated head according to line III—III in FIG. 2.

In the first embodiment of the invention, shown in FIGS. 2 and 3, the adjusting piece 2 is shown, in each instance, in different partial sections. The adjusting piece 2 comprises a collar 12 which is constructed so as to be rotationally symmetrically, the lever 7 of the centrifugal weight adjuster 1 acting on its side facing the centrifugal weight adjuster 1 with the intermediary of a roller bearing 13. A sleeve portion 14 of the adjusting piece 2 is arranged within the roller bearing 13; the end of the shaft 8, on which the adjusting piece 2 is axially displaceable, projects into the inner borehole 10 of the sleeve portion 14. On the side of the collar 12 remote of the sleeve portion 14, there is provided an articulated head 15 which is constructed in this embodiment so as to form one piece with the adjusting piece 2 and comprises a cross bearing with a transverse borehole 16 having an elongated cross section (oblong hole) through which an axle 17 projects. The articulated head 15 and the axle 17 are fixed relative to one another by means of a pin 18 which penetrates both of them, so that the axle 17 is swivelable around the pin 18 by a certain angle which is defined by the cross section of the transverse borehole 16 (FIG. 3).

On the free axle ends 19 of the axle 17, are supported the end of the brackets 20 of a guide lever 21, which is constructed so as to have two arms, and the ends of a double arm deflecting lever are also supported and ends 19 by the lever system 3. Two arms or levers 22 are connected to each other by means of a pin 23. The adjusting lever 5 acts on an arm of the deflecting lever 22 by means of a crank 24, which is only shown schematically. A swiveling axle 25 for a control lever 26, which is supported at one end 27 in the governor housing, is arranged at the free end of the other arm of the deflecting lever 22, and the quantity control member 4, particularly a control rod, is articulated at the other end 28. The ends of the guide lever 21 remote of the axle 17 are arranged so as to be swivelable in the governor housing by means of a stationary pivot bearing 29 on which is also supported the end of a force lever 30. A governor spring 31, which works counter to the centrifugal force, acts on the force lever. The force lever 30 is supported with its end 32 at a stop 33 of the housing. A torque control device 34 with a torque control spring 35 is provided between the articulated head 15 and the force lever 30; the torque control spring 35 first gives way after a determined centrifugal force or rate of rotation and accordingly influences the characteristic line of the governor, which is determined until this point by the governor spring 31. In this way, the injection quantity is "controlled" as the quantity which is combustible by the engine so as to be free from soot.

This centrifugal speed governor, according to the invention, which is constructed as an idling speed governor in the first embodiment example, works in the following manner: if the maximum regulation point speed is exceeded at a determined adjustment of the adjusting lever 5, a force is exerted on the adjusting piece 2 by means of the centrifugal force of the centrifugal weights 6 via the angle lever 7, which force displaces this adjusting piece 2 against the force of the spring 31 or 35. In so doing, the guide lever 21 is displaced by means of the axle 17 and carries the control lever 26 and force lever 30 along. By means of the carrying along of the control lever 26 the quantity control member 4 is moved into a position for a lower injection quantity and, because of the carrying along of the force lever 30, the spring 31 or 35 must be overcome until a new position of equilibrium is reached. Before this limiting speed is reached, the injection quantity can be adjusted, as desired, for accelerating or slowing down the engine by means of the adjusting lever 5. For this purpose, the deflecting lever 22 is adjusted by means of the crank 24 so that the control lever 26 is likewise swiveled in a desired position by means of the swiveling axle 25. The control of the idling speed functions, in principle, like that of the maximum speed, with the exception that as soon as the engine falls below a certain speed the speed governor brings the quantity control member 4 into a position for greater injection quantities until an equilibrium is reached here, as well.

Naturally, the invention is not limited to idling speed governors; rather, it is applicable in an equally favorable way in variable-speed governors (all-speed governors). In these all-speed governors, in contrast to the idling speed governors, the intermediate speed, which is adjutable as desired in the latter, is also governed, so that the lever arrangement differs somewhat from that shown in FIG. 1.

The deflecting lever 22 is not required and the governor spring again acts on the force lever on the one hand, but, on the other hand, in contrast to the idling speed governor, it acts on a swivel lever which is adjustable by means of the adjusting lever, which latter is adjustable as desired, wherein the pretensioning of the governor spring changes in accordance with the swiveling position. Thus, it is certainly possible that the second embodiment example shown in FIGS. 4 to 6 finds an application in variable-speed governors, just as the first embodiment example can be used in these governors. Since the invention is usable in both governors, a more detailed description of a variable-speed governor is dispensed with.

Figure 5:
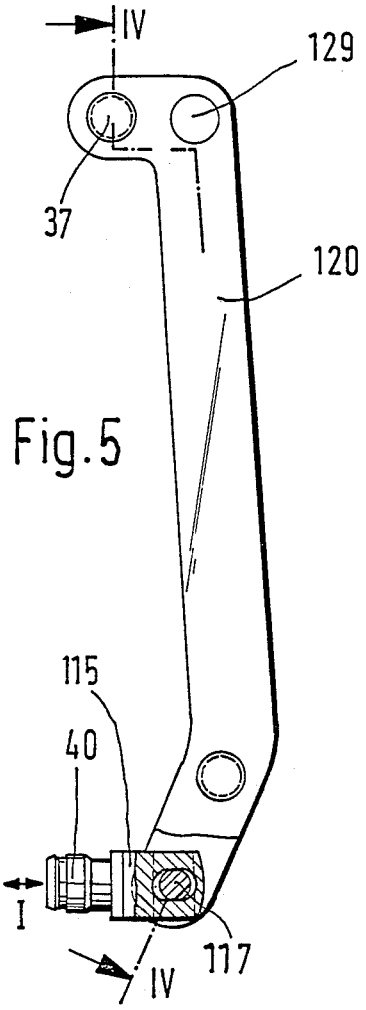
FIGS. 4 to 6 show the second embodiment in three section views, respectively.
Figure 4:
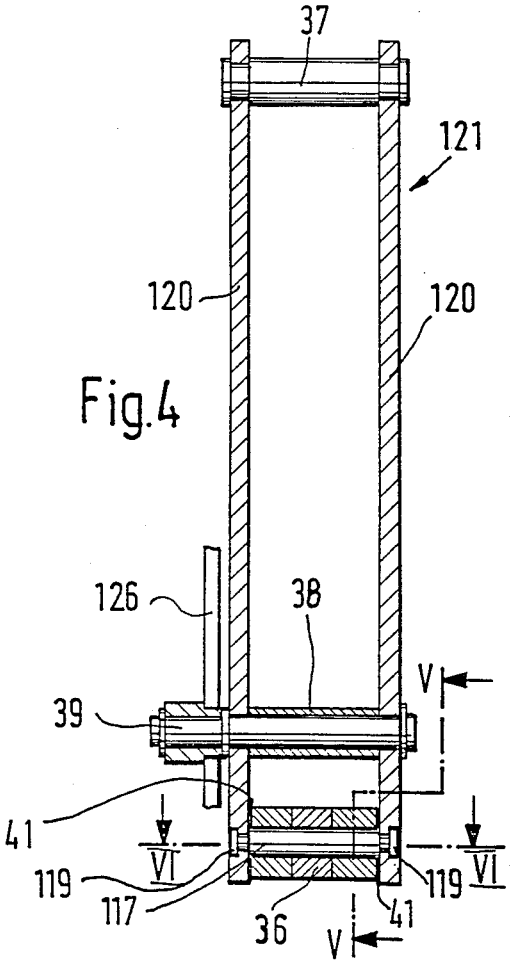
Figure 6:
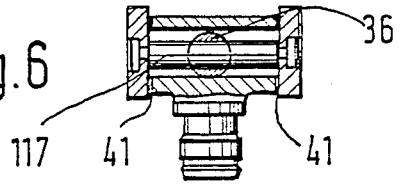

With respect to the second embodiment example, only the guide lever 121, in its box-like form, and the articulated head 115 are shown, specifically, in FIG. 4, as a longitudinal section, in FIG. 5, as a partial section and view according to line V—V in FIG. 4, and, in FIG. 6, as a section according to line VI—VI in FIG. 4.

Here, as well, the guide lever 121 comprises two brackets 120 which are securely connected with one another by means of the axle 117 of the articulated head 115 and by means of a spacer pin 37 at the other end of the lever. The connection is constructed here by means of riveting the axle ends 119 or the ends of the spacer pin 37. An additional stiffening is achieved by means of a bush 38 which is clamped between the two brackets 120 and in which a bearing pin 39 is guided so as to be gripped axially, the control lever 126 being supported on the bearing pin 39. In this way, a relatively torsion-resistant system is effected, in which the arrangement of the stationary pivot bearing 129 contributes to the stiffening.

In contrast to the first embodiment, the articulated head 115 is constructed so as to be separate from the adjusting piece 2 and comprises a plug-in piece 40 for the centrifugal force adjuster. In contrast to the first embodiment, the axle 117 penetrates a cross pin 36 which, on the other hand, also passes through the articulated head 115. There is a play 41 between the articulated head 115 and the bracket 120 so that a possible transverse displacement of the articulated head 115 on the axle 117 relative to the adjusting direction indicated by means of the double arrow I is also provided.

All of the characteristic features shown in the description, the following claims and the drawing can be substantial to the invention individually as well as in a desired combination with one another.

What is claimed is:

1. Centrifugal speed governor of fuel injection pumps for internal combustion engines, comprising:

an adjusting piece;

a centrifugal force adjuster which causes an axial adjusting movement of said adjusting piece against the force of at least one spring and which is driven synchronously with an engine speed;

a feed quantity adjusting member;

a guide lever, on which said spring acts at least indirectly, said guide lever at least indirectly transmitting said adjusting movement to said feed quantity adjusting member and being supported, in addition, on a pivot bearing and being formed of two parallel brackets, which are securely connected with one another, said guide lever being formed as a double-armed lever; and an articulated head between said adjusting piece and said guide lever, said articulated head having a connection provided in said adjusting direction of said adjusting piece toward said adjusting piece and being also connected with said guide lever by two axial ends, each at which engages with one of the brackets, the improvement comprising:

an axle (17) penetrating said articulated head (15), said brackets (20) forming an inherently rigid frame by means of cross connections (17,37,38), said axle ends (19) being ends of said axle (17), said axle (17) being arranged in a borehole (16) formed in said articulated head (15), said borehole (16) extending vertically relative to said adjusting direction and said brackets (20), said borehole (16) having an cross section elongated in said adjusting direction, and said axle (17) being supported in said borehole (16) approximately in a center of said axle (17) by a cross bearing (18, 36), which extends vertically relative to said axle and relative to said adjusting direction, so that said axle can execute a limited swiveling movement about said cross bearing in said borehole (16).

2. Centrifugal speed governor according to claim 1, wherein a pin (18) is provided, which penetrates said articulated head (15) at least partially and said axle (17) completely, said pin being said cross bearing.

3. Centrifugal speed governor according to claim 1, wherein a cross pin (36) is provided, which penetrates said articulated head (115) at least partly and is penetrated by said axle (117) completely, said pin being said cross bearing.

4. Centrifugal speed governor according to claim 1, wherein a play is formed between said articulated head (15) and said brackets (20) of said guide lever (21).

5. Centrifugal speed governor according to claim 1, wherein said axle ends (119) are securely connected with said brackets (120).

6. Centrifugal speed governor according to claim 1, wherein a spacer pin (37) is provided between said brackets (120) in the vicinity of said pivot bearing (129) of said guide lever (121), said spacer pine (37) being a cross connection and securely connected with said brackets at both sides.

* * * * *